US005394813A

United States Patent [19]

Shimoyama et al.

[11] Patent Number: 5,394,813

[45] Date of Patent: Mar. 7, 1995

[54] APPARATUS FOR SEWING AN ELASTIC TAPE ON AN EDGE OF A WORKPIECE

[75] Inventors: Tsuguhiro Shimoyama, Ayabe; Katsumi Tabuchi, Miyazu; Yoshikazu Kageyama, Sakai, all of Japan; Akira Teranishi, Kaiserslautern, Germany; Hourin Jo, Osaka, Japan

[73] Assignee: Pegasus Sewing Machine Mfg. Co., Ltd., Osaka, Japan

[21] Appl. No.: 133,870

[22] Filed: Oct. 12, 1993

[51] Int. Cl.[6] ..... D05B 27/00; D05B 37/04; D05B 35/06

[52] U.S. Cl. ..... 112/121.26; 112/305; 112/130; 112/137

[58] Field of Search ..... 112/121.26, 305, 152, 112/137, 138, 130, 139

[56] References Cited

U.S. PATENT DOCUMENTS

| | | | |
|---|---|---|---|
| 1,560,219 | 11/1925 | Cunningham | 112/137 |
| 3,680,509 | 8/1972 | Miller | 112/152 |
| 4,067,273 | 1/1978 | Marforio | 112/130 |
| 4,635,575 | 1/1987 | Schips | 112/121.26 |
| 4,703,706 | 11/1987 | Plante | 112/130 X |
| 5,081,945 | 1/1992 | Bozoglou | 112/121.26 |

*Primary Examiner*—Clifford D. Crowder
*Assistant Examiner*—Paul C. Lewis
*Attorney, Agent, or Firm*—Jones, Tullar & Cooper

[57] ABSTRACT

An apparatus is provided for automatically inserting an elastic tape into a binding tape, and simultaneously sewing the leading and trailing ends of the elastic tape with the binding tape to the hem of a workpiece. A pair of feed rollers and a tensioning device for the elastic tape are provided above a vertical cylindrical guide. An outlet of the vertical cylindrical guide is directed toward the presser foot of a sewing machine, and shifted between positions on and outside the sewing line of the sewing machine. A cutting device for the elastic tape in the direction crossing with the advancing direction is driven by a shaft vertically placed along the vertical cylindrical guide. An advancing speed of the trailing end of the cut elastic tape extending to the presser foot is reduced by a tape pressing device until the trailing end is fed under the presser foot.

6 Claims, 10 Drawing Sheets

APPARATUS FOR SEWING AN ELASTIC TAPE ON AN EDGE OF A WORKPIECE

BACKGROUND OF THE INVENTION

The present invention relates to a sewing apparatus used for hemming briefs for men and shorts for women, and is designed for wrapping the bottom of a leg part of a workpiece with a binding tape and sewing the binding tape thereon, while inserting an elastic stretched tape into the binding tape and sewing an end part of the elastic tape.

Conventionally, an apparatus for automatically inserting an elastic tape into a binding tape, while wrapping the bottom part of briefs or shorts with the tape, and sewing the leading and trailing ends of the elastic tape to the bottom part is disclosed in Japanese Utility Model Publication Sho. 62-15033. However, one of the problems associated with this apparatus is that it causes waste, because the elastic tape is cut together with the binding tape after the sewing operation, the elastic tape being cut to the same length as that of the binding tape, even when it is required as part of a bottom part. A tape feed apparatus having an elastic tape cutter provided before a sewing area is disclosed in Japanese Utility Model Publication Sho. 54-6604. One problem associated with this apparatus is that an air cylinder for driving a knife of the cutter is laterally projected, thus, a large space is required. Another problem is that, when a tape which is fed in a stretched state with high tension is cut before the sewing area of the sewing machine, the cut and released tape end is contracted, drawn toward a sewing needle, and sewn on a workpiece in the contracted state, thus, a long part with insufficient elasticity is left after the sewing operation.

SUMMARY OF THE INVENTION

Hence, it is an object of the present invention to provide an apparatus for sewing a binding tape on a workpiece, while automatically inserting an elastic tape in a stretched state into the binding tape, and simultaneously sewing the leading and tail ends of the elastic tape on the binding tape and workpiece. It is another object of the present invention to provide an apparatus for cutting an elastic tape that is inserted into a binding tape to a length shorter than that of the binding tape at the sewing end of the workpiece. The present invention is characterized in that tape feeding means and cutting means are provided in a compact arrangement in the apparatus. According to the present invention, the apparatus comprises a binder guide before the presser foot of a sewing machine for cylindrically folding a binding tape and a cylindrical guide for guiding an elastic tape into the binding tape that is cylindrically folded. The cylindrical guide is provided for passing an elastic tape fed from an upper side therethrough, and guiding it to the vicinity of the binder guide, and divided into an to upper cylindrical guide and a lower cylindrical guide with a device for cutting the elastic tape between them. In the apparatus of the present invention, the elastic tape advances under the presser foot in a stretched state by a tape tensioning device. Desirably, an oscillating device for the lower cylindrical guide is provided in the apparatus. The oscillating device comprises an actuator for vertical motion along the upper cylindrical guide. And the lower cylindrical guide is laterally oscillated by the vertical motion through an intermediate oscillating member that is rotated about a horizontal axis. As the lower cylindrical guide is oscillated laterally at the tape outlet by the oscillating device, the elastic tape is guided at the initial and tail ends thereof to a position on a sewing line at which it is sewn to a hem of the workpiece, and a middle part of the elastic tape is displaced from the position on the sewing line. As a result, because the middle part of the elastic tape is unsewn, and left in a free condition, the workpiece comes to be elastic in the hem part after the sewing operation.

It is desirable that a tape pressing device is employed in the lower cylindrical guide and is driven by a vertically moving actuator. The tape pressing device serves for resisting advancement of the elastic tape, and preventing the tape from being drawn rapidly toward a sewing machine after it is cut, and the elastic tape is sewn to a workpiece in a stretched state until released from the tape pressing device.

A movable blade composing the elastic tape cutting device is fixed to the lower end of a driving shaft placed vertically along the upper cylindrical guide, and rotated in a plane perpendicular to the advancing direction of the elastic tape with the driving shaft. The oscillating device oscillates the lower cylindrical guide about a horizontal axis by means of a piston rod of an air cylinder that is vertically expanded and contracted along the upper cylindrical guide. By providing-both the driving shaft for the movable blade and the air cylinder for the oscillation of the lower cylindrical guide along the upper cylindrical guide, as described above, a large space is not required, and the sewing operation can be smoothly conducted without obstruction by the oscillating device, the tape pressing device and the cutting device.

The above and other objects and novel features of the present invention will be more clearly understood hereinbelow by reading a detailed description of the embodiments. However, such embodiments are shown only as examples, and do not limit the scope of the present invention.

DETAILED DESCRIPTION OF THE PREFERRED EMBODIMENTS

Figure 1:
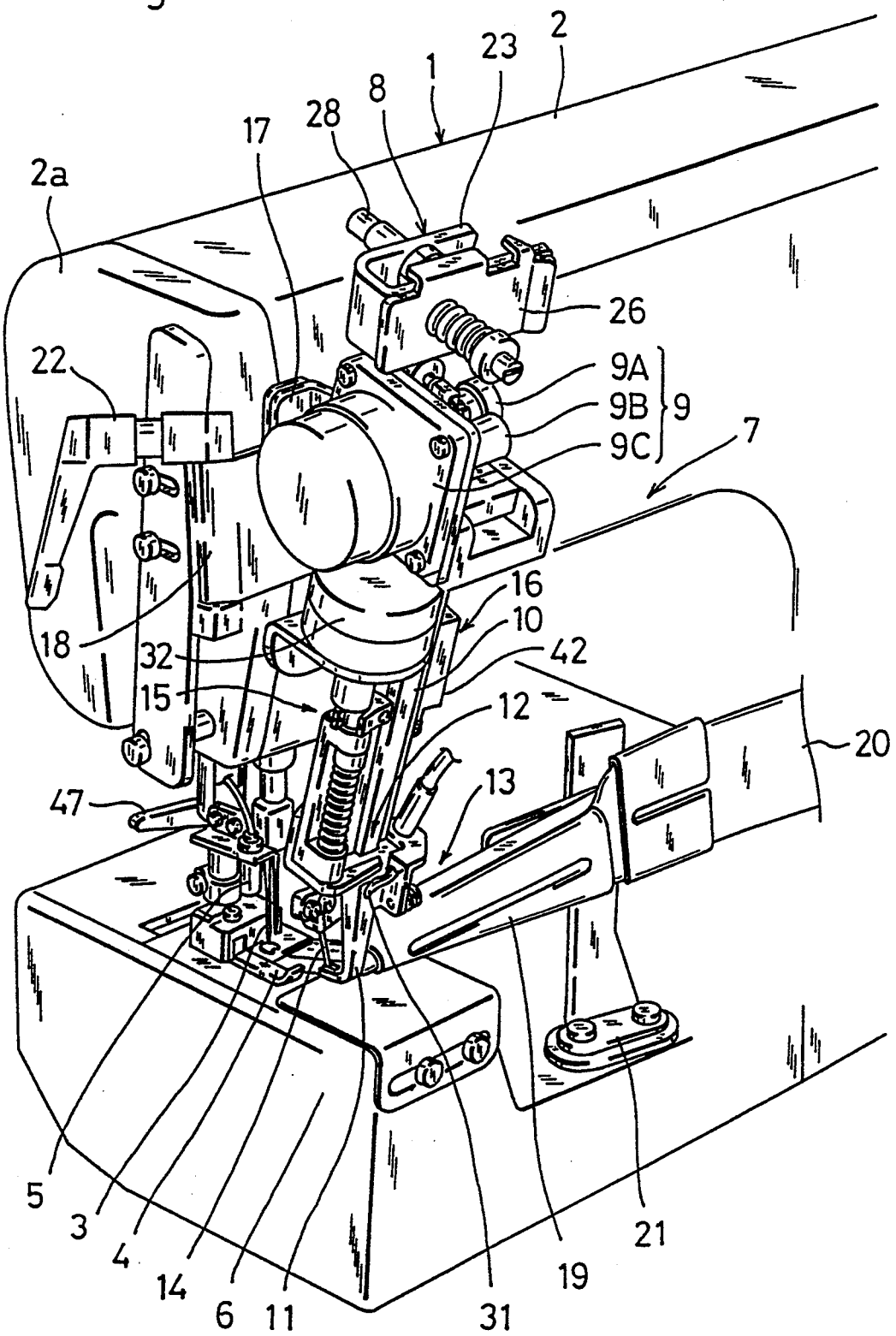
FIG. 1 is an overall perspective view showing an apparatus of the present invention.

In FIG. 1, a sewing machine is depicted by reference numeral 1, and under the free end of an arm 2 a sewing area is defined by providing sewing needles 3, a presser foot 4, a sensor 5 for detecting a cloth end, and a sewing bed 6 containing a feed dog and a looper on a lower part thereof (neither of them being shown). A feeding unit for an elastic tape shown by numeral 7 comprises a pinch-type tape tensioning device 8, a feeding device 9, an upper cylindrical tape guide 10, a lower cylindrical tape guide 11, a cutting device 12, a tape pressing device 13, a tape detecting fiber sensor 14, a cutter driving device 15, and a driving device 16 for oscillation of the lower cylindrical tape guide. The feeding unit 7 is attached to a face plate 2*a* of the arm 2 by means of a bracket 17 having a hinge 18, and is rotatable between a sewing operating position adjacent to the arm 2 and a standby position beside the operating position. The feeding unit 7 is fixed by a clam nut 22 at the operating position or standby position. During preparation for sewing an elastic tape 24, threading on the looper and maintenance inspection of the feeding unit and sewing machine, sufficient operating space can be obtained by displacing the feeding unit 7 from the operating position to the standby position apart from the face plate 2*a* of the arm 2.

A binding tape guide 19 supported by a bracket 21 is placed before the sewing bed 6, and a binding tape 20 is led to the sewing area as it is cylindrically folded by the binding tape guide 19.

Figure 2:
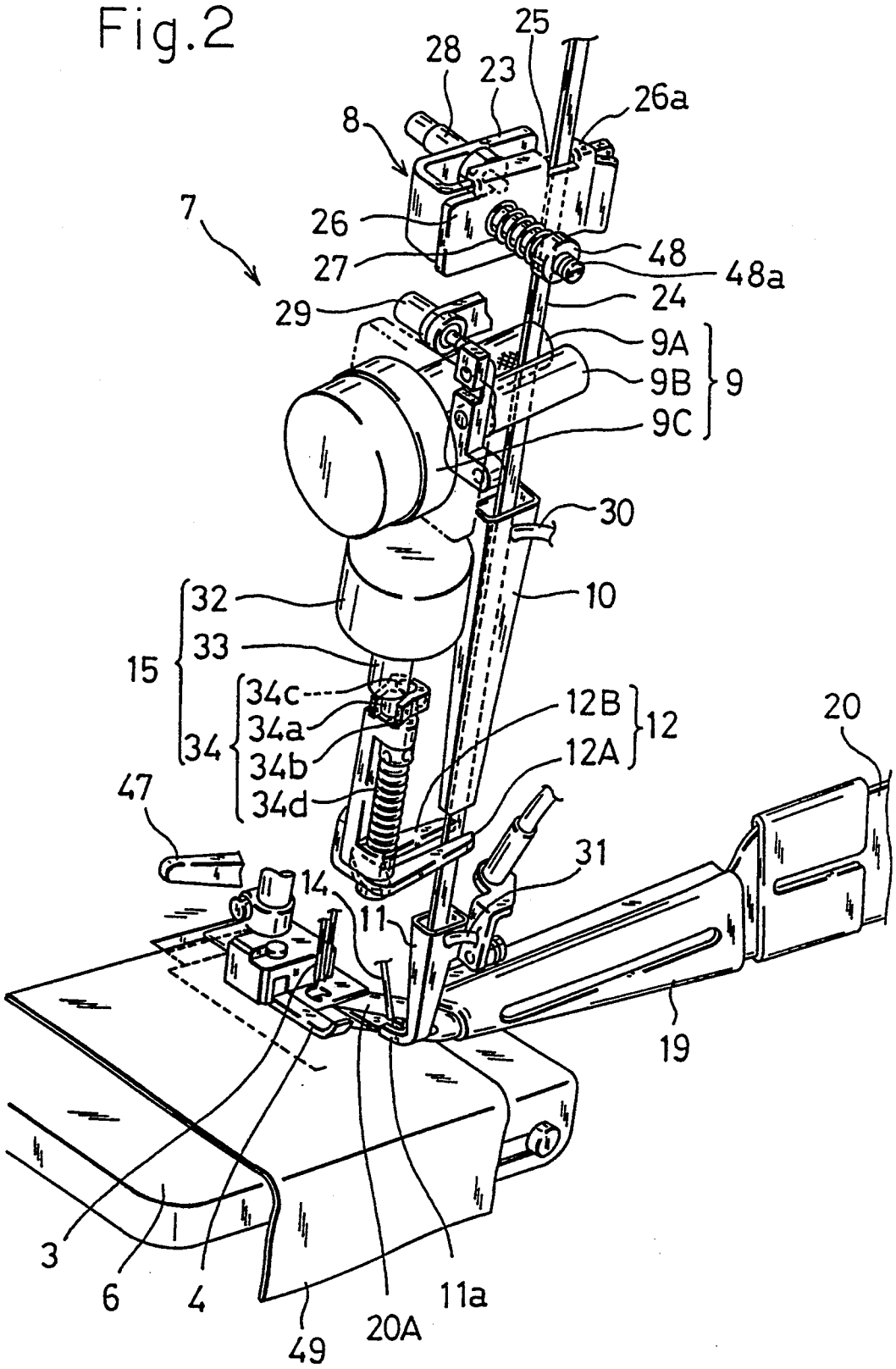
FIG. 2 is a magnified perspective view showing a main part of an elastic tape feeding unit.
Figure 6:
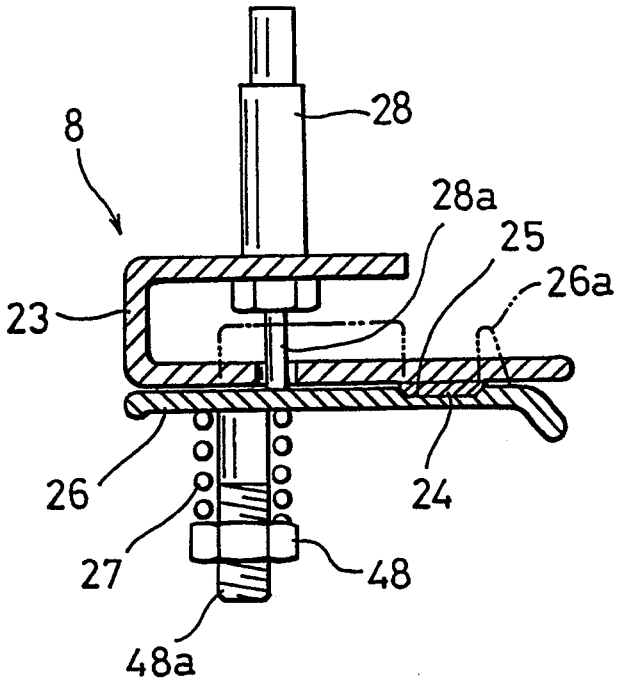
FIG. 6 is a partial sectional plan view of a tape tensioning device.

As shown in FIGS. 2 and 6, the tape tensioning device 8 is designed for pinching the elastic tape 24 between an outer surface of one of the prongs of a base plate 23 that is bent in a U shape and a presser plate 26. The presser plate 26 is pressed against the base plate 23 by a coil spring 27 fitted in a bolt 48*a* that is fixed to the base plate 23 and a nut 48. The tension of the elastic tape 24 is adjusted by turning the nut 48. The presser plate 26 is provided with a notch 25 for insertion of the elastic tape 24 and a projection 26*a* for preventing lateral deviation. An air cylinder 28 is fixed to the other prong of the U-shaped base plate 23, and a pinching force against the elastic tape 24 can be released by projecting a piston pin 28*a* of the cylinder, and separating the presser plate 26 from the base plate.

The feeding device 9 comprises a driving roller 9A, a nip roller 9B and a motor 9C for driving the roller 9A. The driving roller 9A and nip roller 9B comprise a feed roller. The nip roller 9B can be moved between positions in contact with and apart from the driving roller 9A by an air cylinder 29.

Air hoses 30, 31 are connected respectively to the upper and lower cylindrical guides 10 and 11 at each upper part thereof, and the elastic tape 24 fed from the feeding device 9 can be smoothly suspended down into the cylinders by blowing compressed air into the upper and lower cylindrical tape guides 10 and 11 to the lower direction thereof. The lower cylindrical tape guide 11 is horizontally bent toward the presser foot 4 in an outlet part 11*a* at its bottom end.

The elastic tape 24 passing from the feeding device 9 through the upper and lower cylindrical tape guides 10 and 11 is inserted into a binding tape 20A formed in a cylindrical shape by the binding tape guide 19, and both tapes are fed under the presser foot 4.

The cutting device 12 cuts the elastic tape 24 at an angle perpendicular to the advancing direction between the upper and lower cylindrical tape guides 10 and 11. The cutting device 12 comprises a stationary blade 12A and a movable blade 12B that slides along the stationary blade, and the movable blade 12B is reciprocally rotated by the cutter driving device 15. As shown in FIG. 2, the cutter driving device 15 is equipped with a vertical shaft 33 rotated by a reciprocal rotary actuator (rotary air cylinder or rotary solenoid) 32, and an eccentric mechanism 34. The eccentric mechanism 34 has an eccentric pin 34*a* placed in the lower end of the vertical shaft 33 and a rotational shaft 34*c* with a forked lever 34*b* fixed to its upper end and the movable blade 12B to its lower end. The movable blade 12B is reciprocally rotated by operation of the actuator 32 so as to cut the elastic tape 24 in combination with the stationary blade 12A. A coil spring 34*d* is fitted around the rotational shaft 34*c* for pressing the movable blade 12B against the stationary blade 12A. Because the vertical shaft 33 and rotational shaft 34*c* are separated, and combined by means of the eccentric mechanism, as described above, for maintaining a play between the shafts, the movable blade 12B is always pressed against the stationary blade 12A by the coil spring 34*d*, and the elastic tape 24 is securely cut. Since the cutting device 12 and the cutter driving device 15 are employed along the upper cylindrical tape guide 10, a compact size is achieved, and a large space is not required even during operation.

A rear cutter 47 operated perpendicularly to a sewing line is placed in back of the presser foot 4 of the sewing machine. The rear cutter 47 cuts off a tail of the cylindrical binding tape protruding from a rear end of workpiece 49 after it is sewn to the workpiece 49.

Figure 3:
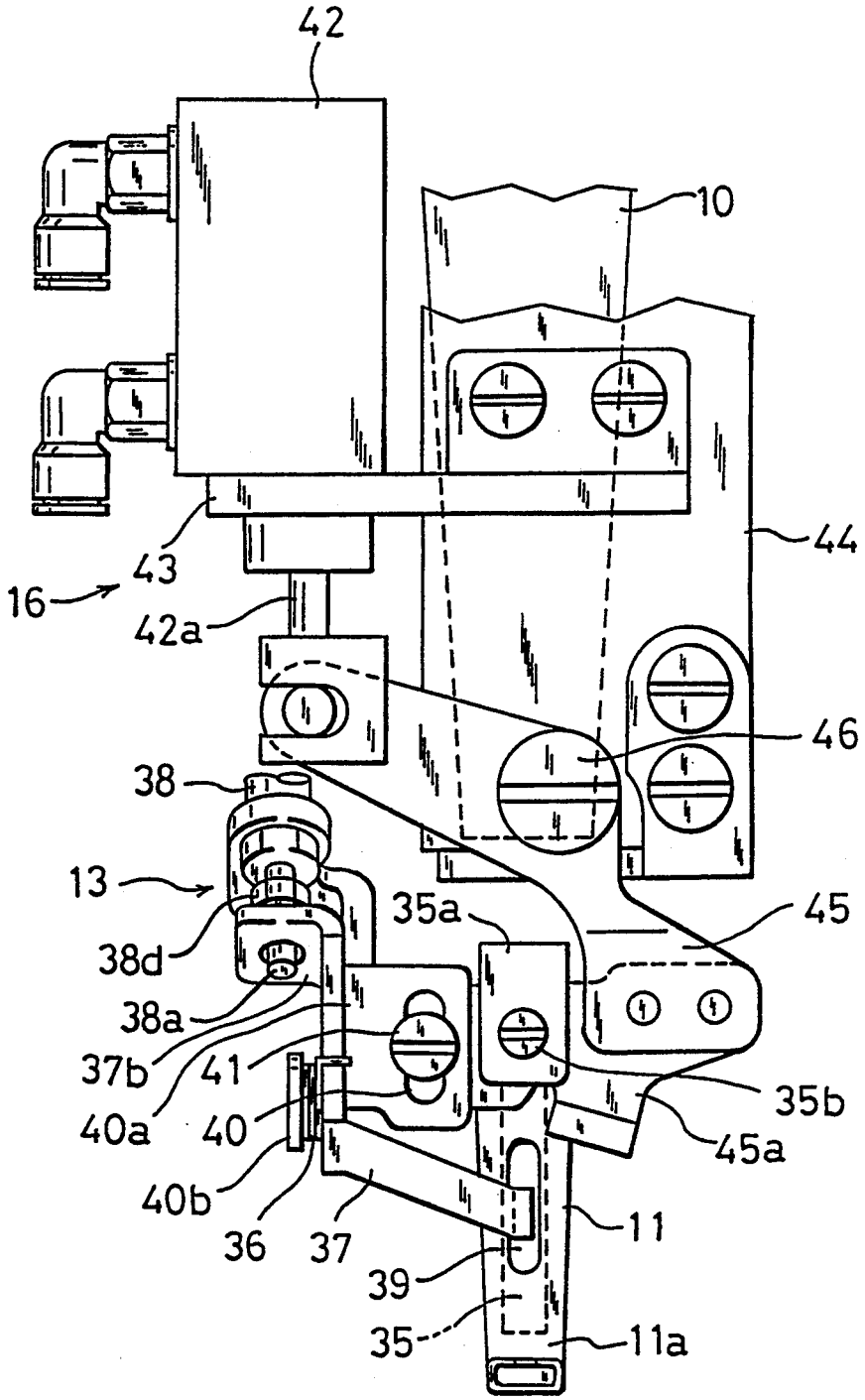
FIG. 3 is a front view showing an elastic tape pressing device and a driving device for a lower cylindrical guide.
Figure 4:
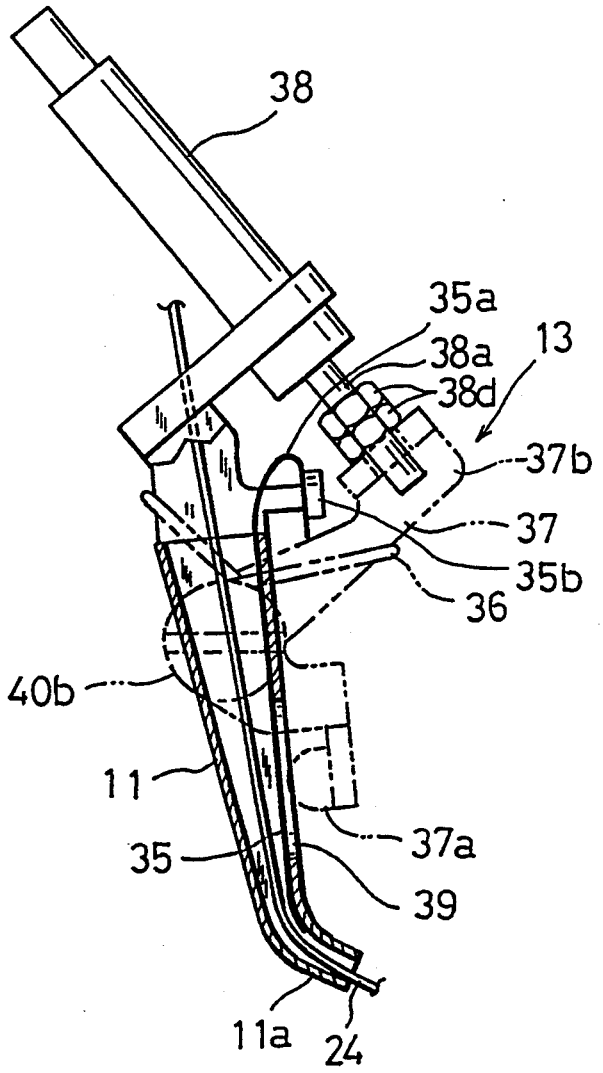
FIG. 4 is a vertical sectional view showing the elastic tape pressing device in a non-operating state.
Figure 5:
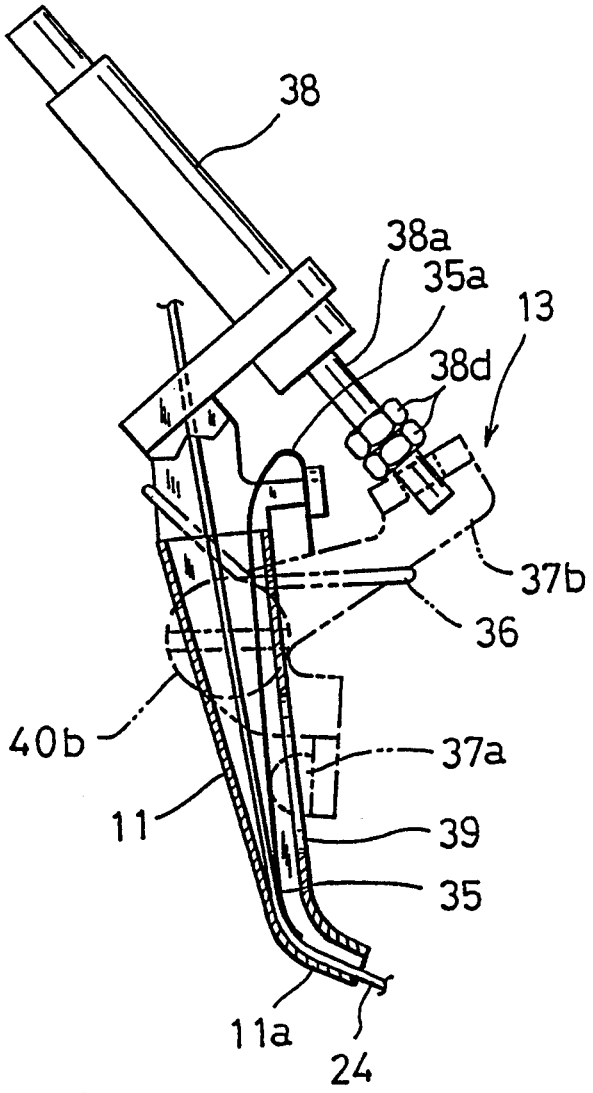
FIG. 5 is a vertical sectional view showing the elastic tape pressing device in an operating state.

As shown in FIGS. 3, 4 and 5, the tape pressing device 13 is provided with a tape presser spring plate, or tape pressing member 35 comprising a spring leaf with an operating end positioned inside the lower cylindrical tape guide 11, a pressing rod, or presser arm 37 for pressing the tape pressing member 35 against an inner wall of the cylindrical tape guide 11 and an air cylinder 38 for driving the presser arm 37. An upper end 35*a* of the tape pressing member 35 is bent over in an inverted J shape and fixed to the lower cylindrical tape guide 11 by a screw 35*b*. The presser arm 37 has an operating end 37*a* and a driven end 37*b*, and is rotatably attached by a pin 40*b* to a bracket 40*a* which is fixed to the cylindrical tape guide 11 by means of a slit 40 and a screw 41. The operating end 37*a* is in contact with the tape pressing member 35 through a slit 39 on the cylindrical wall of the cylindrical tape guide 11, and the driven end 37*b* abuts with a nut 38*d* which is fitted on a piston pin 38*a* of air cylinder 38. When the piston pin 38*a* is projected, the presser arm 37 is rotated in the clockwise direction in FIGS. 4 and 5, and the tape pressing member 35 is pressed toward the inner wall of cylindrical tape guide 11. The pressure is released by forcing it counterclockwise by means of a spring 36 fitted around the pin 40*b*, when the piston pin 38*a* is retracted. The pressure can be adjusted by means for adjusting by positioning of the nut 38*d* on the piston pin 38*a* or the slit 40 and screw 41.

The driving device 16 for oscillating the lower cylindrical tape guide 11 is shown in FIG. 3. It comprises an air cylinder 42 (having a piston rod 42*a* that is moved in the vertical direction) fixed through a mounting plate 44 to the upper cylindrical tape guide 10 by a bracket 43 and an intermediate oscillating member 45 rotatably supported on a horizontal shaft 46 which is fixed to the mounting plate 44. The intermediate oscillating member 45 is connected at one end to the piston rod 42*a* and at the other end to the cylindrical tape guide 11 through the bracket 45*a*. The outlet part 11*a* of the cylindrical tape guide 11 is laterally oscillated between a position on a sewing line L shown in FIG. 8 and a position spaced rightward by a distance $\Delta L$ from the sewing line L. By such oscillation, the elastic tape 24 fed from the cylindrical tape guide 11 is sewn by the sewing needles 3 only when the outlet part 11A is on the line L.

In the apparatus, operation of the devices are controlled on the basis of a rotation signal of the sewing machine, in other words, a stitch count number N, and a timing of the operations is inputted to a control panel 50 in correspondence with the requirements of various workpieces. The operations are described by referring to FIGS. 7, 8 and 9.

Figures 7A, 7B, 7C, 7D, 7E, 7F, 7G, 7H, 7I, 7J:
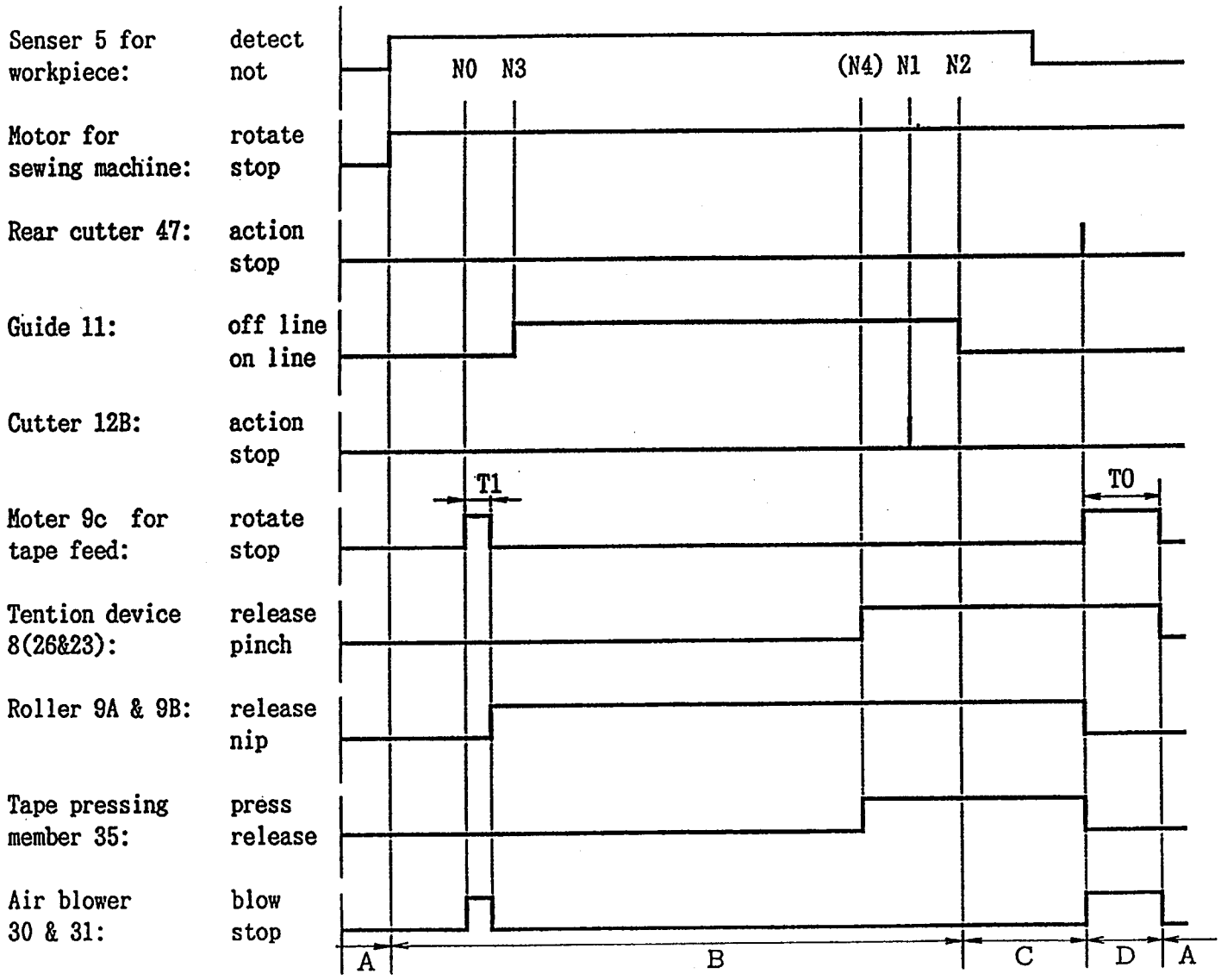
FIG. 7 is a time chart for explaining operation of an embodiment.

First of all, in FIG. 7, a period immediately after the cylindrical binding tape 20A is cut by operation of the rear cutter 47, and the sewing operation of the elastic tape 24 is completely over on the first workpiece is shown by a reference symbol D. The period D corresponds to a preparation time of TO secs for projecting the leading end of the elastic tape 24 that is sewn on the next workpiece in a predetermined length from a detecting point of the sensor 14, and is inputted by using a tape inserting amount setter 50*a* of the control panel 50 shown in FIG. 9. During the period D, by bringing the nip roller 9B in contact with the driving roller 9A, actuating the motor 9C for feeding tape, and blowing air from the air hoses 30, 31 into the upper and lower cylindrical tape guides 10, 11, the elastic tape 24 is fed through the predetermined length. During such operations, as the piston pin 28*a* is projected, the presser plate 26 is separated from an outer surface of the base plate 23 against the spring 27, and the elastic tape 24 is released from being pinched.

After T0 secs, the motor 9C and air blowing are stopped, the piston pin 28*a* is retracted, and the elastic tape 24 is pinched between the presser plate 26 and the base plate 23 by the spring 27 to proceed to a standby period A. During the standby period A, all operations are stopped.

Then, a sewing period B is initiated as the workpiece 49, detected by the sensor 5, is supplied onto the sewing bed 6. And then, counting of the number of stitches is started. When the count value reaches a value N0 that is set at a setter 50*b* in the control panel 50 for initiation of tape feeding, the tape feeder motor 9C is rotated for a setting time T1, for example 500 miliseconds, air blowing is supplied from the air hoses 30, 31, and the elastic tape 24 fed some length so that the elastic tape 24 is inserted into the binding tape 20A. Here, the outlet of the lower cylindrical tape guide 11 is on the sewing line L of sewing machine 1. After that, the air cylinder 29 is expanded in order to separate the nip roller 9B from the driving roller 9A. Then, the elastic tape 24 is pulled out, while being tensioned by the tape tensioning device 8, and sewn on the workpiece 49 together with the binding tape 20A in a length 12 of a tape part 24A.

Figure 8:
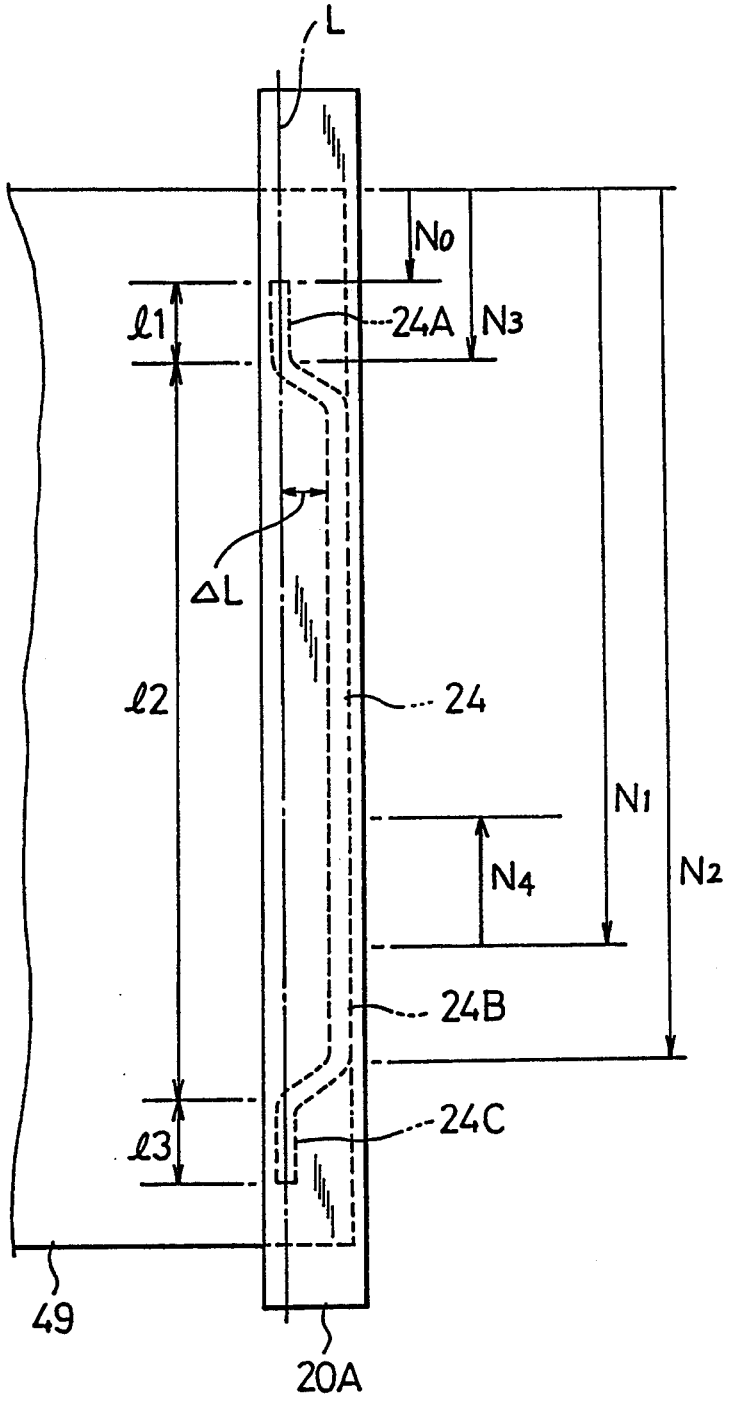
FIG. 8 is a drawing of a sewing model for explaining the operation of the embodiment.

During the sewing period B, when the count value reaches a value N3 that is set at a setter 50*c* in the control panel 50 for initiating oscillation of the lower cylindrical guide 11, by actuating the air cylinder 42, and switching the lower cylindrical guide 11 so that the elastic tape 24 is fed to a location outside the sewing line L, as shown in FIG. 8, a point of insertion of the elastic tape 24 to the binding tape 20A is displaced by the distance ΔL, and an elastic tape part 24B of length 12 is released from the binding tape 20A.

Succeedingly, when the count value reaches a value N1 minus N4 that is set at a setter 50*d* in the control panel 50 for initiation of tape pressing, the presser plate 26 is separated from the outer surface of the base plate 23 for releasing the pinching operation by projecting the piston pin 28*a*, while the tape pressing member 35 is simultaneously switched from a state shown in FIG. 4 to that shown in FIG. 5 by means of the presser arm 37, and the elastic tape 24 in the lower cylindrical guide 11 is elastically pressed against the inner wall of the guide to apply feeding resistance.

When the count value reaches a value N1 set at a setter 50*e* in the control panel for initiating operation of the cutter, by actuating the rotary cylinder 32 of the cutter driving device 15, and sliding the movable blade 12B against the stationary blade 12A, the elastic tape 24 is cut between the upper and lower cylindrical guides 10, 11. Subsequently to the cutting operation, both cut ends would be rapidly drawn toward the presser foot 4 and toward the upper direction, as the tape is released from its tension. But as the elastic tape 24 in the lower side of the cutting point is pressed by the pressing member 35 against the inner surface of the lower cylindrical guide 11, and as the elastic tape 24 in the upper side of the cutting point is released from being pinched by the pinch-type tensioning device 8 and the pair of rollers 9A, 9B, such rapid drawing is prevented. Specifically, the elastic tape 24 in a lower side of the cutting point is kept in the pressed attitude until the trailing end is advanced under the presser foot 4, so that its insertion through a predetermined length of the binding tape 20A is assured.

After the cutting operation, when the count value reaches a value N2 set at a setter 50*f* in the control panel for resetting oscillation of the lower cylindrical guide, the air cylinder 42 is activated, and the lower cylindrical guide 11 is switched so as to feed the cut end of the elastic tape 24 onto the sewing line L. In a succeeding final sewing period C, as shown in FIG. 8, an elastic tape part 24C of a length 13 is sewn on the workpiece 49 together with the binding tape 20A, then, as soon as the sewing operation is completed, the rear cutter 47 is activated by a sensor signal or manual operation, and the binding tape 20A is cut.

Figure 9:
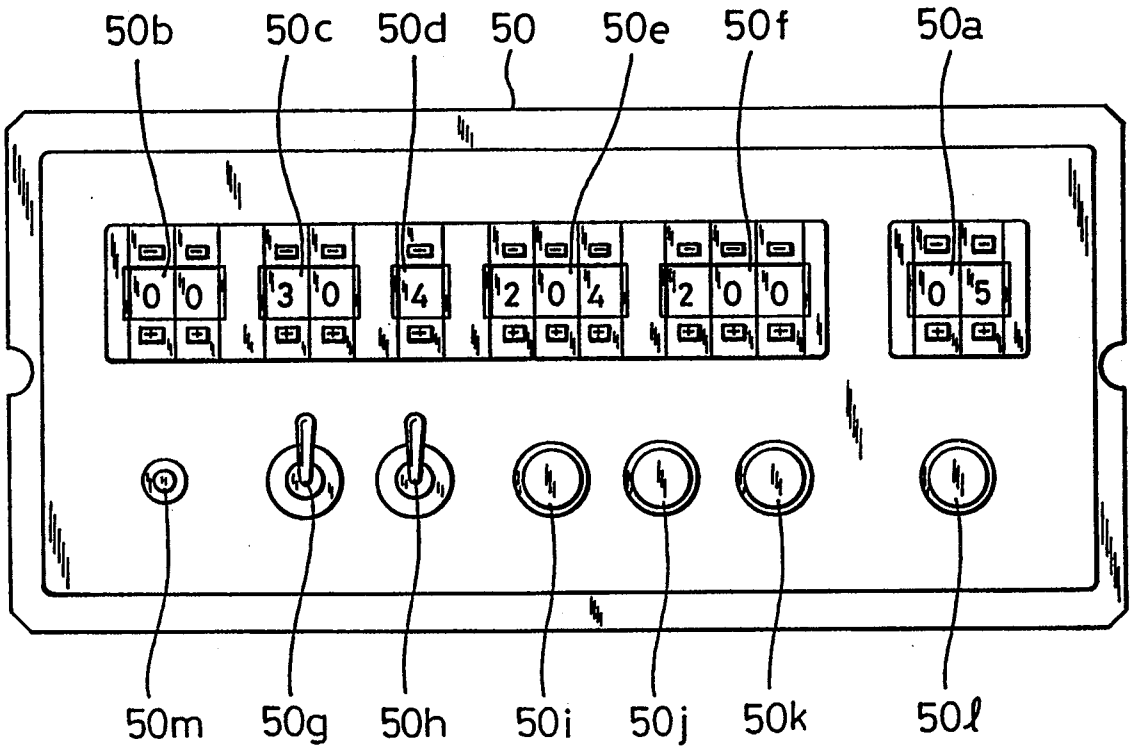
FIG. 9 is a layout drawing of a control panel.

In FIG. 9, an on/off switch of oscillation driving device 16 for the lower cylindrical guide 11 is shown by a reference numeral 50*g*, an on/off switch of the end detecting sensor 5 by 50*h*, a manual button for tape feeding by 50*i*, a manual button for operation of the cutter driving device 15 by 50*j*, a preset button by 50*k*, a reset button by 50*l*, and a power indicator lamp by 50*m*.

Although such maintenances as service and inspection of various components of the tape feeding unit 7 and threading to the looper and initial setting of the elastic tape 24 are facilitated, if the tape feeding unit 7 is arranged for allowing switching between a sewing position and a standby position, as in the embodiment, it may be fixed to the sewing position.

Figure 10:
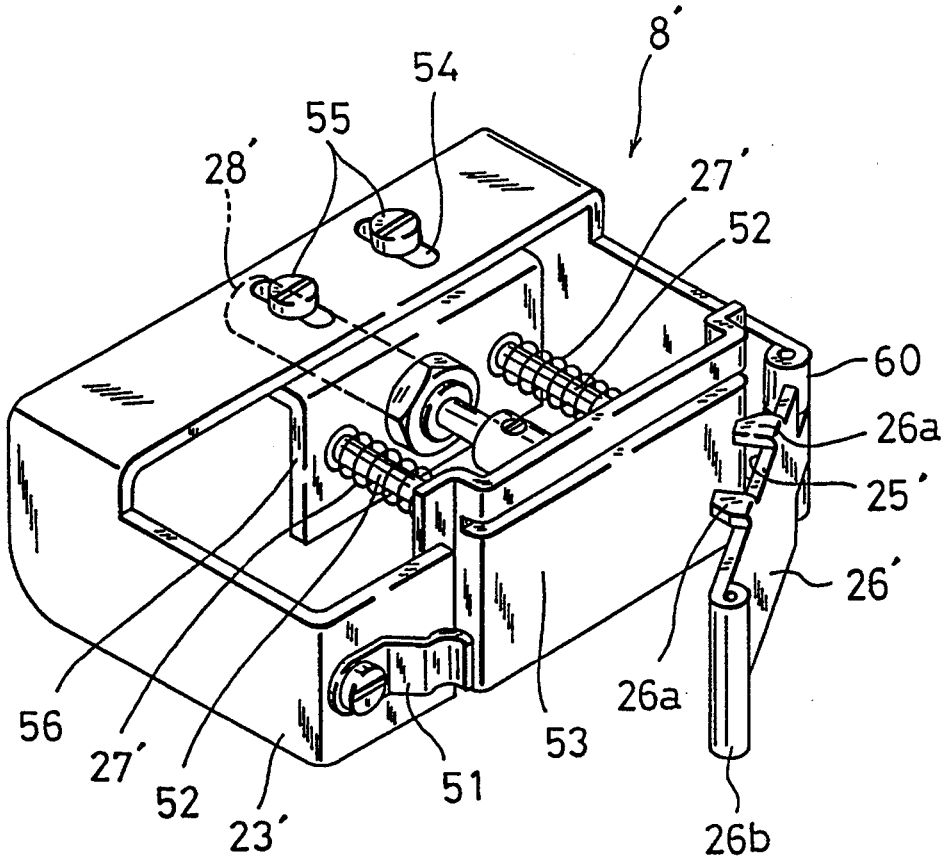
FIG. 10 is a magnified perspective view of a tape tensioning device in another embodiment.

FIG. 10 is a magnified perspective view showing a tape tensioning device of another embodiment, wherein a tape presser plate 26' having a notch 25' for insertion of the elastic tape 24 and projections 26*a*, 26*a* for preventing lateral deflection is provided for rotatably opening and closing against a frame or base plate 23' by means of a hinge 60. The presser plate 26' is secured in a closed position to a side of the base plate 23' by an anchoring member 51 comprising a curved spring plate fixed on the base plate 23' and an anchoring handle 26*b* formed in a tubular shape at a free end of the tape presser plate 26'. A movable presser plate 53 has a slit 61 for fitting the projections 26*a* and is slidably supported by two guide pins 52 on a movable plate 56 fixed on the base plate 23'. The movable presser plate 53 is elastically forced and moved to a side of the presser plate 26' by means of a coil spring 27' wound about the guide pins 52 so that the elastic tape 24 is elastically pinched between the movable presser plate 53 and presser plate 26', and the pinching force can be released by contracting an air cylinder 28' connected to the base plate 23'. In addition, the movable plate 56 is adjustable by slits 54 and fixing screws 55 for positioning in the sliding direction. Thus, by adjusting the position of movable plate 56, the pinching force applied to the elastic tape 24 by means of the spring 27' can be controlled.

The tape tensioning device shown in FIG. 10 provides similar functions to those of the embodiment shown in FIG. 6 as well as such advantage that the presser plate 26' can be easily released, and setting of the elastic tape 24 on the device is facilitated. Such a tape tensioning device as shown in FIG. 10 can be directly attached to the sewing arm 2.

What is claimed is:

1. An apparatus for sewing a binding tape on a workpiece, while automatically inserting an elastic tape into the binding tape and simultaneously sewing the leading and trailing ends of the elastic tape on the binding tape and the workpiece, the apparatus comprising:

a binder guide for folding the binding tape in a cylindrical shape, the binder guide being placed before a presser foot of a sewing machine; and a vertical cylindrical guide for passing the elastic tape therethrough so that the elastic tape is guided into the binding tape formed in the cylindrical shape, wherein;

a pair of feed rollers for pinching and feeding the elastic tape is provided above the vertical cylindrical guide, the vertical cylindrical guide comprises upper and lower cylindrical guides with an outlet of the lower cylindrical guide directed toward the presser foot of the sewing machine, and an oscillating device for driving the lower cylindrical guide so that the outlet is shifted between positions on and outside a sewing line, the oscillating device is provided with an intermediate oscillating member connected to the lower cylindrical guide, said intermediate oscillating member being oscillated by a cylinder placed vertically along the upper cylindrical guide, and the piston of the cylinder is contracted and expanded in the vertical direction, and a cutting device is provided between the upper and lower cylindrical guides for cutting the elastic tape in a direction crossing to an advancing direction, and comprises a stationary blade and movable blade pressed against each other, a cutter shaft positioned vertically along the upper cylindrical guide with the movable blade fixed to a lower end thereof and an actuator connected to an upper part of the cutter shaft for oscillation thereof, and having an oscillation axis parallel with the cutter shaft.

2. An apparatus according to claim 1, wherein the cutter shaft and the oscillation axis of the actuator are connected by means of an eccentric mechanism, and a coil spring for pressing the stationary and movable blades are fitted on the cutter shaft.

3. An apparatus according to claim 1, wherein the pair of feed rollers, the vertical cylindrical guide, the cutting device and the oscillating device are integrated as an elastic tape feeding unit through a bracket, and the elastic tape feeding unit can be oscillated between an operating position adjacent to a front side of an arm of the sewing machine and a standby position at a side thereof by a hinge on the bracket.

4. An apparatus for sewing a binding tape on a workpiece, while automatically inserting an elastic tape into the binding tape and simultaneously sewing the leading and trailing ends of the elastic tape on the binding tape and the workpiece, the apparatus comprising:

a binder guide for folding the binding tape in a cylindrical shape, the binder guide being placed before a presser foot of a sewing machine and a vertical cylindrical guide for passing the elastic tape therethrough so that the elastic tape is guided into the binding tape formed in the cylindrical shape, wherein;

a feeding device is placed above the vertical cylindrical guide, and having a pair of rollers for pinching and feeding the elastic tape, a tape tensioning device placed above the vertical cylindrical guide for tensioning the elastic tape that is advanced through the vertical cylindrical guide toward the presser foot of the sewing machine, a cutting device arranged between the tape tensioning device and the presser foot for cutting the elastic tape in a direction crossing to a tape advancing direction, and a tape pressing device placed in the vertical cylindrical guide between the cutting device and the presser foot, having a presser spring plate and a presser arm for pressing the elastic tape against an inner surface of the vertical cylindrical guide through the presser spring plate, and reducing the advancing speed of the elastic tape unsewn and extending to the presser foot, wherein the vertical cylindrical guide is divided into upper and lower cylindrical guides, so that the elastic tape is cut between the cylindrical guides by the cutting device, the lower cylindrical guide has an outlet directed toward the presser foot of the sewing machine, and is provided with an oscillating device for driving the lower cylindrical guide such that the outlet is shifted between positions on and outside a sewing line of the sewing machine, and the oscillating device is connected to the lower cylindrical guide and oscillated by a cylinder which is placed vertically along the upper cylindrical guide and operated in the vertical direction.

5. An apparatus according to claim 4, wherein the tape tensioning device comprises a presser plate with a hinge mounted to a frame of the device so as to be opened and closed by rotating against the frame, a spring and a cylinder, and a movable presser plate supported slidably to the frame and biased to the presser plate by the spring and the cylinder for releasing a pinching force applied on the presser plate and the movable presser plate.

6. An apparatus according to claim 4, wherein the tape pressing device includes an air cylinder and means for adjusting the pressure applied to the tape, and wherein the tape pressing device can be switched between an operating state and a non-operating state by means of the air cylinder operated in the vertical direction.

* * * * *